United States Patent [19]

Garner, Jr.

[11] 4,336,841

[45] Jun. 29, 1982

[54] MECHANICAL TUBING ANCHOR

[75] Inventor: James K. Garner, Jr., Houston, Tex.

[73] Assignee: Camco, Incorporated, Houston, Tex.

[21] Appl. No.: 207,161

[22] Filed: Nov. 17, 1980

[51] Int. Cl.[3] ..... E21B 33/128; E21B 33/129

[52] U.S. Cl. ..... 166/216; 166/139; 166/217

[58] Field of Search ..... 166/216, 217, 139, 140

[56] References Cited

U.S. PATENT DOCUMENTS

| | | | |
|---|---|---|---|
| 2,851,108 | 9/1958 | Reed | 166/139 |
| 3,412,801 | 11/1968 | Young | 166/139 |
| 3,420,306 | 1/1969 | Brown | 166/139 |
| 4,274,489 | 6/1981 | Harris | 166/139 |
| 4,296,806 | 10/1981 | Taylor et al. | 166/139 |

*Primary Examiner*—James A. Leppink

*Attorney, Agent, or Firm*—Fulbright & Jaworski

[57] ABSTRACT

A tubing anchor for anchoring a well tubing in an outer conduit which includes slips and upper and lower cones. A threaded connection is connected to at least one of the cones for moving the cones towards and away from each other for setting and releasing the slips. First and second clutches are selectively actuated by longitudinal movement of a mandrel for either setting or releasing the slips. The anchor may also be released by an emergency straight pull on the mandrel.

8 Claims, 3 Drawing Figures

MECHANICAL TUBING ANCHOR

BACKGROUND OF THE INVENTION

It is common to utilize threadably actuated slips for anchoring tubing in a well in an outer conduit such as a casing for preventing movement of the tubing during the application of either upward or downward forces to the tubing and at the same time functioning as a tubing catcher.

The present invention is directed to an improved rotational set tubing anchor which is preferably right-hand set and right-hand release and may also be equipped with a straight pull emergency release backup system.

SUMMARY

The present invention is directed to a rotationally set tubing anchor including slips and first and second slip cones. Threaded means are connected to at least one of the cones for moving the cones towards and away from each other for setting and releasing the slips. A mandrel is adapted to be connected to the tubing and by longitudinal movement selectively actuates either first or second clutches. The first and second clutches are connected to the threaded means whereby rotation of the mandrel will set the slips upon engagement of the first clutch and will release these slips upon engagement of the second clutch and upon rotation of the mandrel.

Yet a further object of the present invention is the provision of a tubing anchor for anchoring a well tubing in an outer conduit including a first mandrel adapted to be connected to the tubing and a second mandrel coaxially positioned with the first mandrel. Slip means are mounted exteriorly of the mandrels and includes first and second cones for setting and releasing the slip means. A body surrounds the first mandrel and includes a threaded connection to the first cone and the second mandrel is connected to the second cone and threadably connected to the body. Setting clutch means are provided between the first mandrel and the body for setting the slip means on rotation of the first mandrel and a releasing clutch is provided between the first and second mandrels whereby rotation of the second mandrel by the first mandrel will release the slip means.

Still a further object of the present invention is wherein the setting clutch is engaged by longitudinal movement of the first mandrel in the first direction and the releasing clutch is engaged by longitudinal movement of the first mandrel in a second direction.

Still a further object is the provision of shear means connected between the body and the first mandrel for initially securing the setting clutch in engagement.

Still a further object is the provision of shear means connected between the second mandrel and the second cone for providing an emergency release of the set anchor.

Still a further object of the present invention is the provision of a rotationally set tubing anchor having slips and two clutches which are selectively set by longitudinal movement of a mandrel in which the anchor is set by right-hand rotation and is released by right-hand rotation and also includes an emergency longitudinal straight pull release system.

Other and further objects, features and advantages will be apparent from the following description of a presently preferred embodiment of the invention, given for the purpose of disclosure and taken in conjunction with the accompanying drawings.

BRIEF DESCRIPTION OF THE PREFERRED EMBODIMENT

Figure 1:
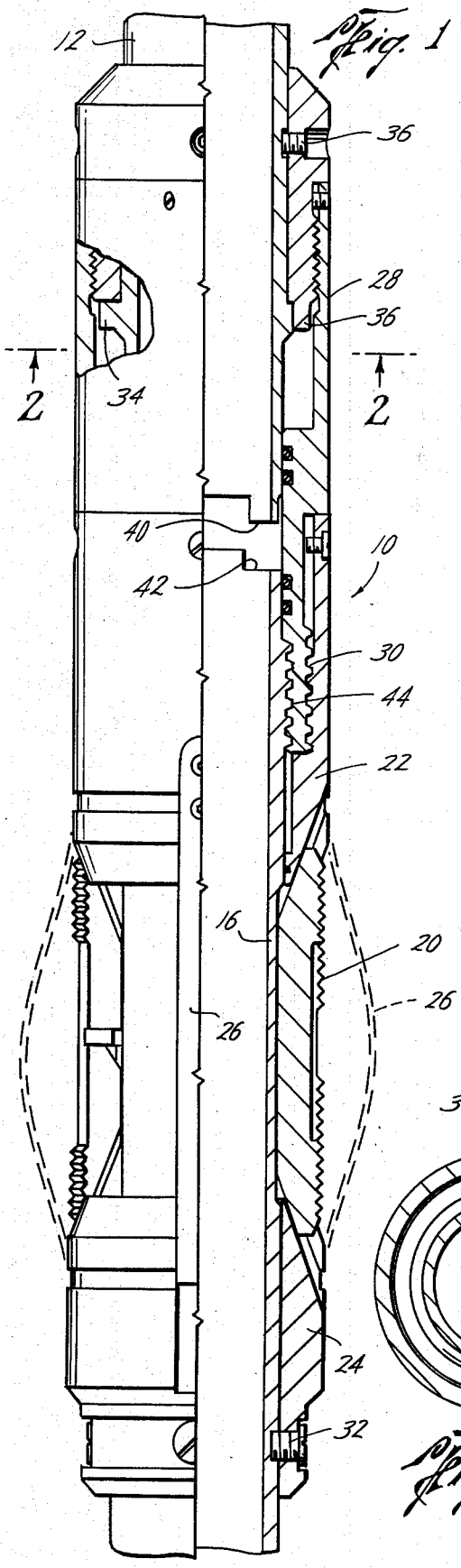
FIG. 1 is a fragmentary elevational view, partly in cross section, of the tubing anchor of the present invention in its running in position.
Figure 2:
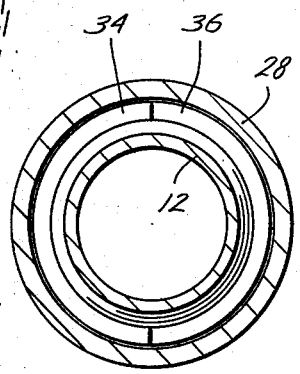
FIG. 2 is a cross-sectional view taken along lines 2—2 of FIG. 1.

Referring now to the drawing, and particularly FIG. 1, the reference numeral 10 generally indicates the tubing anchor of the present invention. The anchor 10 generally includes a first mandrel 12 adapted to be connected to the tubing by suitable connecting means such as threads (not shown). A second mandrel 16 is provided coaxially positioned with the first mandrel 12 and may include suitable connecting means such as threads (not shown) for connection to additional equipment. Slip means such as conventional bi-directional slips 20 are provided mounted exteriorly of the mandrels 12 and 16 and includes a first or upper cone 22 and a lower or second cone 24 which are conventionally connected to the slips 20 by dovetail connections. Suitable friction means such as bow springs 26 are connected to the slip means for engaging an outer conduit for restricting the rotation of the slips 20 and cones 22 and 24 during the setting operation.

A body 28 is rotatably mounted about the first mandrel 12 and includes a threaded connection 30 to the first cone 22 whereby right-hand or clockwise rotation of the body 28 will move the first cone 22 downwardly towards the second cone 24 and expand the slips 20 outwardly into a setting position. The lower cones 24 are secured to the second mandrel 16, preferably by shear pins 32.

A setting clutch means is provided between the first mandrel 12 and the body 28 such as a half ring 34 on the mandrel 12 and a half ring 36 on the body 28 which when engaged allows the rotation between the mandrel 12 and the body 28, in either direction. The clutch members 34 and 36 are engaged upon upward movement of the mandrel 12 relative to the body 28 and are disengaged by downward longitudinal movement of the mandrel 12 relative to the body 28. Therefore, rotation of the mandrel 12 with the clutch members 34 and 36 engaged will transmit rotation to the body 28 and thus to the upper cone 22 to the threaded connection 30 for setting the slips 20. Preferably, one or more shear pins 36 are provided connecting the body 28 initially to the upper mandrel 12 holding the clutch members 34 and 36 in engagement.

A releasing clutch means is provided between the first mandrel 12 and the second mandrel 16 such as a plurality of splines 40 on mandrel 14 for engaging a plurality of grooves 42 on the mandrel 16. As shown in FIG. 1, the releasing clutch means is disengaged, but is engageable upon longitudinal downward movement of the first mandrel 12. The second mandrel 16 is connected by a threaded connection 44 to the body 28 whereby rotation, preferably right-hand rotation, will drive the cones 22 and 24 apart thereby retracting the slips 20.

Figure 3:
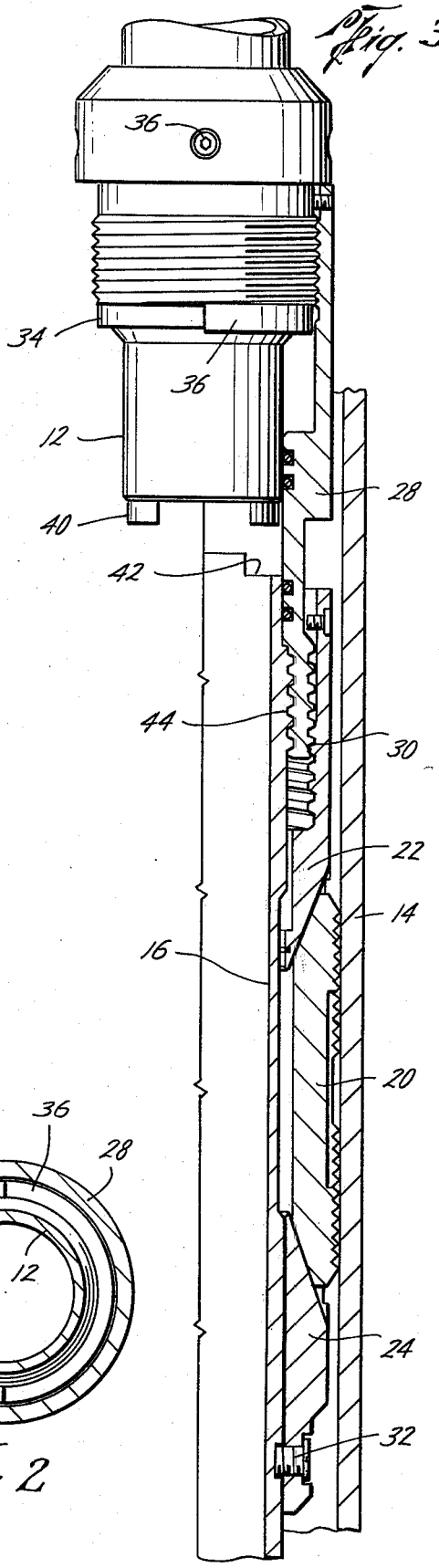
FIG. 3 is a fragmentary elevational view, partly in cross section, of the tubing anchor of the present invention in the set position.

In operation, the tubing anchor 10 is connected to a tubing and inserted in a well and longitudinally moved downwardly as best seen in FIG. 1, preferably several feet below the desired depth. The tubing anchor 10 is then picked up which takes out the slack in the setting clutch by insuring a full engagement between the members 34 and 36 which is particularly desirable if the shear pins 36 connecting the body 28 to the first mandrel 12 are not utilized. The tubing is then rotated to the right until a predetermined torque, such as 2500 foot pounds is reached, which transmits the rotational torque to the body 28 rotating the threaded connection 30 to transmit the torque into a vertical downward movement of the upper cones 22 towards the lower cone 24 which are held from rotation by the bow springs 26. Outward movement of the slips 20 move them into an anchoring engagement with the casing 14. The tubing and tubing anchor 10 is then picked up with a force greater than the weight of the tubing, such as an additional 5000 pounds, to assure that the slips 20 are properly set. The tubing anchor is shown in the set position in FIG. 3.

Prior to the release the anchor 10, sufficient weight must be set downwardly on the anchor to shear the shear pins 36 thereby releasing the setting clutch by disengaging member 34 from member 36. Downward longitudinal movement of the upper mandrel 12 will also move the mandrel 12 towards the mandrel 16 to engage the releasing clutch consisting of the splines 40 and grooves 42. Preferably before releasing the anchor 10 the tubing weight is picked up to about 500 pounds below the neutral point. With the releasing clutch engaged, the tubing is rotated to the right, for example, ten revolutions, to rotate the upper mandrel 12 and the lower mandrel 16 in a right-handed direction whereby the threaded connection 44 between the lower mandrel 16 and the body 28 will move the cones 22 and 24 apart thereby retracting the slips 20. At this time the anchor 10 should be freed. However, it is further desirable to pick up the tubing sufficiently to disengage the releasing clutch consisting of the splines 40 and grooves 42 and again engage the setting clutch consisting of the members 34 and 36 and rotate the tubing and upward mandrel 12 in a left-handed direction such as five revolutions to further insure that the slips 20 are fully retracted and will not drag along the casing during retrieval.

If for some reason the anchor 10 has not been freed by the above procedure, a straight pull, such as 40,000 pounds over the tubing weight will shear the lower shear pins 32 and allow the slips 20 to retract.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. In a tubing anchor for anchoring a well tubing in an outer conduit, and in which the anchor includes slips and first and second slip cones, the improvement comprising, threaded means connected to at least one of the cones for moving the cones toward and away from each other for setting and releasing the slips, a mandrel adapted to be connected to the tubing, first and second clutch means connected to the mandrel, the first clutch means actuated by longitudinal movement of the mandrel in one direction, and the second clutch means actuated by longitudinal movement of the mandrel in a second direction, said first and second clutch means connected to the threaded means whereby rotation of the mandrel will set the slips upon engagement of the first clutch means and will release the slip means upon engagement of the second clutch means upon rotation of the mandrel.

2. In a tubing anchor for anchoring a well tubing in an outer conduit, and in which the anchor includes slips and first and second slip cones, the improvement comprising, threaded means connected to at least one of the cones for moving the cones toward and away from each other for setting and releasing the slips, first and second mandrels, said second mandrel being connected to the threaded means, a first clutch means actuated by engagement in a first direction and positioned between the first mandrel and the threaded means for setting the slips by rotation of the first mandrel, and a second clutch means actuated by engagement in a second direction and positioned between the first and second mandrels for releasing the slips by rotation of the second mandrel by the first mandrel.

3. A tubing anchor for anchoring a well tubing in an outer conduit comprising, a first mandrel adapted to be connected to the tubing, a second mandrel coaxially positioned with the first mandrel, slip means mounted exteriorly of the mandrels and including first and second cones for setting and releasing said slip means, a body surrounding said first mandrel and including a threaded connection to the first cone, said second mandrel connected to the second cone and readably connected to the body, setting clutch means between the first mandrel and said body for setting the slip means on rotation of the first mandrel, and a releasing clutch means between the first and second mandrels whereby rotation of the second mandrel by the first mandrel will release the slip means.

4. The apparatus of claim 3 wherein the setting clutch means is engaged by longitudinal movement of the first mandrel in a first direction and the releasing clutch means is engaged by longitudinal movement of the first mandrel in a second direction.

5. The apparatus of claim 3 including, shear means connected between the body and the first mandrel.

6. The apparatus of claim 3 including, shear means connected between the second mandrel and the second cone.

7. A tubing anchor for anchoring a well tubing in an outer conduit comprising, a first mandrel adapted to be connected to the tubing, a second mandrel coaxially positioned with the first mandrel, slip means mounted exteriorly of the mandrels and including first and second cones for setting and releasing said slip means, a body surrounding said first mandrel and including a threaded connection to the first cone, said second mandrel connected to the second cone and threadably connected to the body, setting clutch means between the first mandrel and said body and engaged by upward movement of the first mandrel for setting the slip means on right-hand rotation of the first mandrel, a releasing clutch means between the first and second mandrels and engaged by downward movement of the first mandrel whereby right-hand rotation of the second mandrel by right-hand rotation of the first mandrel will release the slip means, friction means connected to the slip means for engaging the outer conduit for providing rotation between the slip means and the body, and shear means connected between the second mandrel and the second cone.

8. The apparatus of claim 7 including, shear means connected between the body and the first mandrel initially holding the setting clutch engaged.

* * * * *

UNITED STATES PATENT OFFICE

CERTIFICATE OF CORRECTION

Patent No. 4,336,841 Dated June 29, 1982

Inventor(s) James K. Garner, Jr.

It is certified that error appears in the above-identified patent and that said Letters Patent are hereby corrected as shown below:

Column 4, line 3, delete "readably" and insert -- threadably --

Signed and Sealed this

Fourteenth Day of September 1982

[SEAL]

Attest:

GERALD J. MOSSINGHOFF

Attesting Officer

Commissioner of Patents and Trademarks